US007950929B2

(12) United States Patent
Yu

(10) Patent No.: US 7,950,929 B2
(45) Date of Patent: May 31, 2011

(54) ELECTRICAL TERMINAL AND BOARD-TO-BOARD CONNECTOR WITH THE ELECTRICAL TERMINAL

(75) Inventor: Sheng-Nan Yu, Tu-Cheng (TW)

(73) Assignee: Cheng Uei Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/543,921

(22) Filed: Aug. 19, 2009

(65) Prior Publication Data

US 2011/0045679 A1 Feb. 24, 2011

(51) Int. Cl.
*H01R 12/00* (2006.01)

(52) U.S. Cl. ..... 439/74; 439/660

(58) Field of Classification Search ..... 439/74, 439/660

See application file for complete search history.

(56) References Cited

U.S. PATENT DOCUMENTS 7,674,135 B2 * 3/2010 Zeng ..... 439/660

* cited by examiner

*Primary Examiner* — Ross N Gushi

(74) *Attorney, Agent, or Firm* — Cheng-Ju Chiang

(57) ABSTRACT

An electrical terminal is adapted for being mounted in a connector. The electrical terminal includes an elastic portion of a substantially U-shape which includes a fastening arm and a contact arm spaced from the fastening arm, and a soldering tail connected with a free end of the fastening arm. The contact arm defines a contact area back to the fastening arm for electrically contacting an external mating terminal. The contact area includes a plurality of concave fillisters and contact ribs parallel one another to be alternately arranged and each extended at an incline to an inserting direction of the external mating terminal so that ensures a firm contact between the electrical terminal and the mating terminal.

19 Claims, 5 Drawing Sheets

ELECTRICAL TERMINAL AND BOARD-TO-BOARD CONNECTOR WITH THE ELECTRICAL TERMINAL

BACKGROUND OF THE INVENTION

1. Field of the Invention

The present invention generally relates to a board-to-board connector, and more particularly to an electrical terminal of the board-to-board connector.

2. The Related Art

A conventional board-to-board connector generally includes a receptacle connector and a plug connector which are mated with each other and respectively mounted to a female and a male printed circuit boards to make the printed circuit boards electrically connected with each other. With the development of the miniaturization of electrical products, the board-to-board connector which is disposed in the electrical product is increasingly miniaturized to meet the miniaturization demand of the electrical product. Accordingly, terminals of the board-to-board connector are designed to be increasingly small and thin. However, during the process of inserting/withdrawing the plug connector into/out of the receptacle connector, the terminals are likely to be elastic deformation which may lead to the break of the terminals so that causes an unsteady electrical connection between the receptacle connector and the plug connector.

SUMMARY OF THE INVENTION

An object of the present invention is to provide an electrical terminal adapted for being mounted in a connector. The electrical terminal includes an elastic portion of a substantially U-shape which includes a fastening arm and a contact arm spaced from the fastening arm, and a soldering tail connected with a free end of the fastening arm. The contact arm defines a contact area back to the fastening arm for electrically contacting an external mating terminal. The contact area has a plurality of concave fillisters and contact ribs parallel one another to be alternately arranged and each extended at an incline to an inserting direction of the external mating terminal.

Another object of the present invention is to provide a board-to-board connector including a plug connector. The plug connector includes a first insulating housing vertically defining a plurality of terminal passageways at two opposite sides thereof, and a plurality of electrical terminals disposed at the corresponding terminal passageways. Each of the electrical terminals has an elastic portion of a substantially U-shape which includes a fastening arm and a contact arm spaced from the fastening arm, and a soldering tail connected with a free end of the fastening arm. The contact arm defines a scraggy contact area back to the fastening arm. The fastening arm is fastened in the corresponding terminal passageway with the contact area of the contact arm facing outward, and the soldering tails project out of the two opposite sides of the first insulating housing.

As described above, the contact area of the electrical terminal includes the concave fillisters and the contact ribs arranged alternately to be scraggy so that ensures a firm contact between the electrical terminal and the mating terminal.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
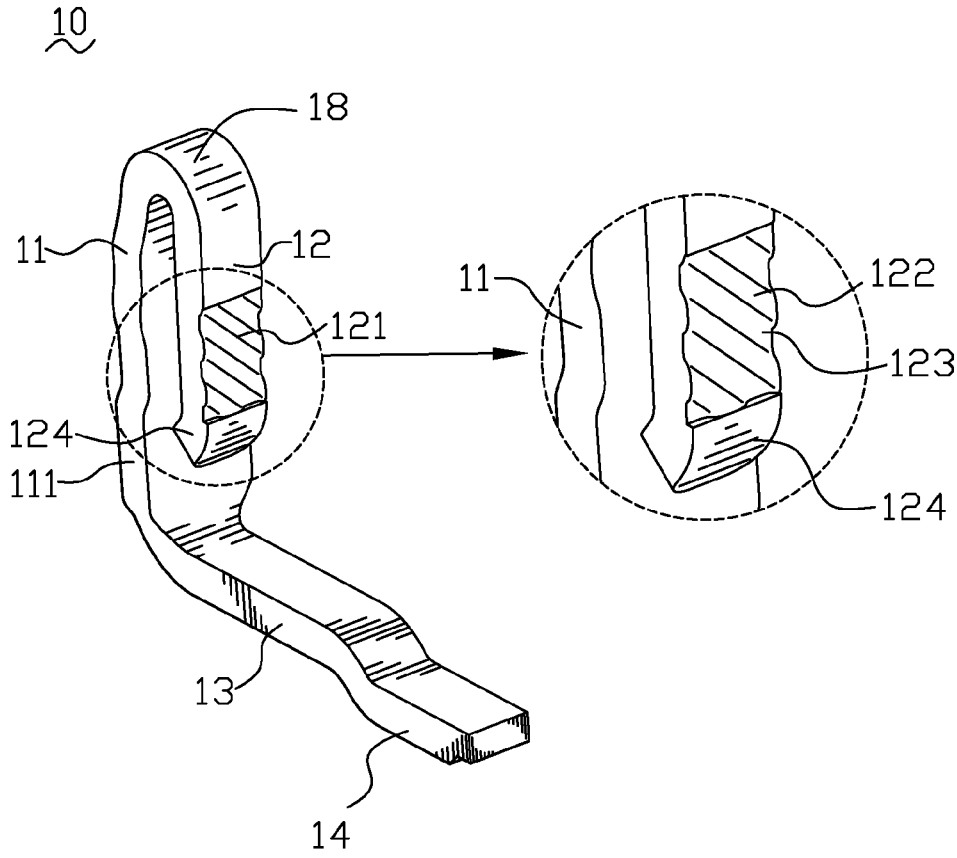
FIG. 1 is a perspective view of an electrical terminal in accordance with the present invention, in which an encircled portion is enlarged.
Figure 2:
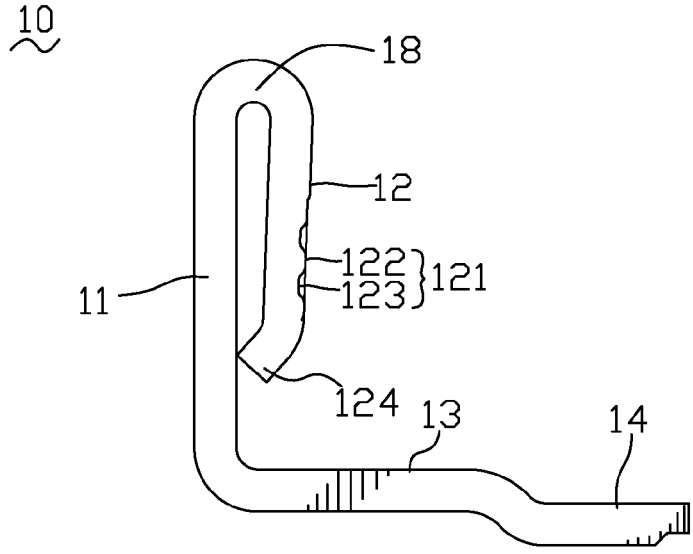
FIG. 2 is a lateral view of the electrical terminal of FIG. 1.

With reference to FIG. 1 and FIG. 2, an electrical terminal 10 in accordance with the present invention is shown. The electrical terminal 10 is stamped from a metal bar and has a substantially U-shaped elastic portion 18. The elastic portion 18 includes a fastening arm 11 and a contact arm 12 spaced from the fastening arm 11. A free end of the fastening arm 11 extends towards a perpendicular direction thereof to form a connecting arm 13 at the same side as the contact arm 12. The contact arm 12 defines a scraggy contact area 121 back to the fastening arm 11. The contact area 121 is composed of a plurality of concave fillisters 123 parallel one another to be arranged at regular intervals and each extended at an incline to an extending direction of the contact arm 12, and a plurality of contact ribs 122 each accordingly formed between the adjacent two concave fillisters 123. The inmost of the concave fillister 123 has a drop of approximate 0.005 mm~0.15 mm relatively to the contact rib 122. A free end of the contact arm 12 is bent towards the fastening arm 11 to form a prop portion 124 against the fastening arm 11 for strengthening the connection of the contact arm 12 and the fastening arm 11. Two opposite side edges of the fastening arm 11 protrude oppositely to form two fastening projections 111. A free end of the connecting arm 13 further extends to form a soldering tail 14.

Figure 3:
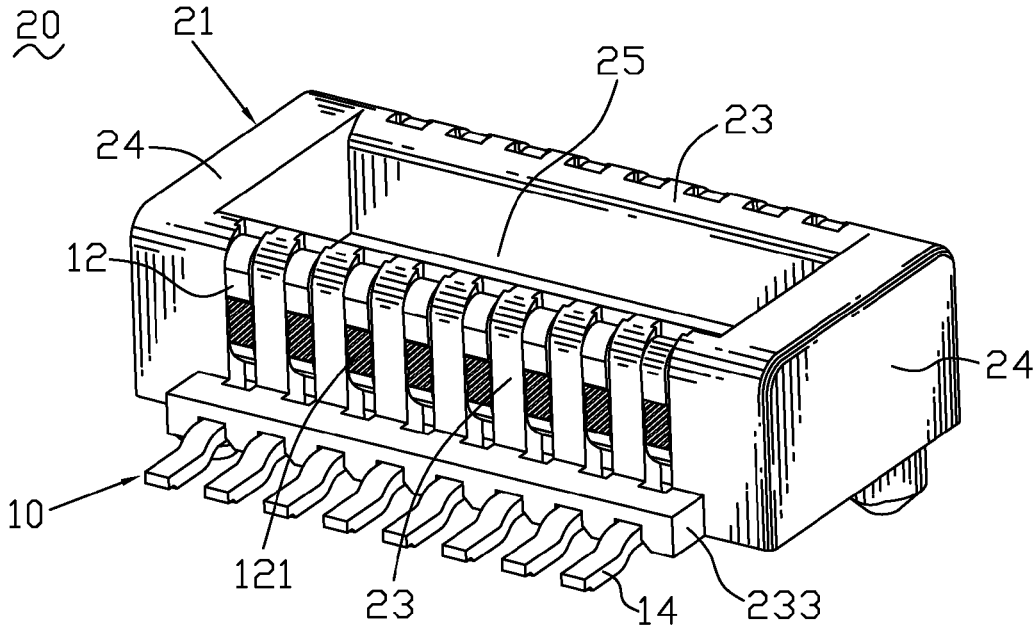
FIG. 3 is a perspective view of a plug connector of a board-to-board connector of the present invention, with the electrical terminal of FIG. 1 therein.
Figure 9:
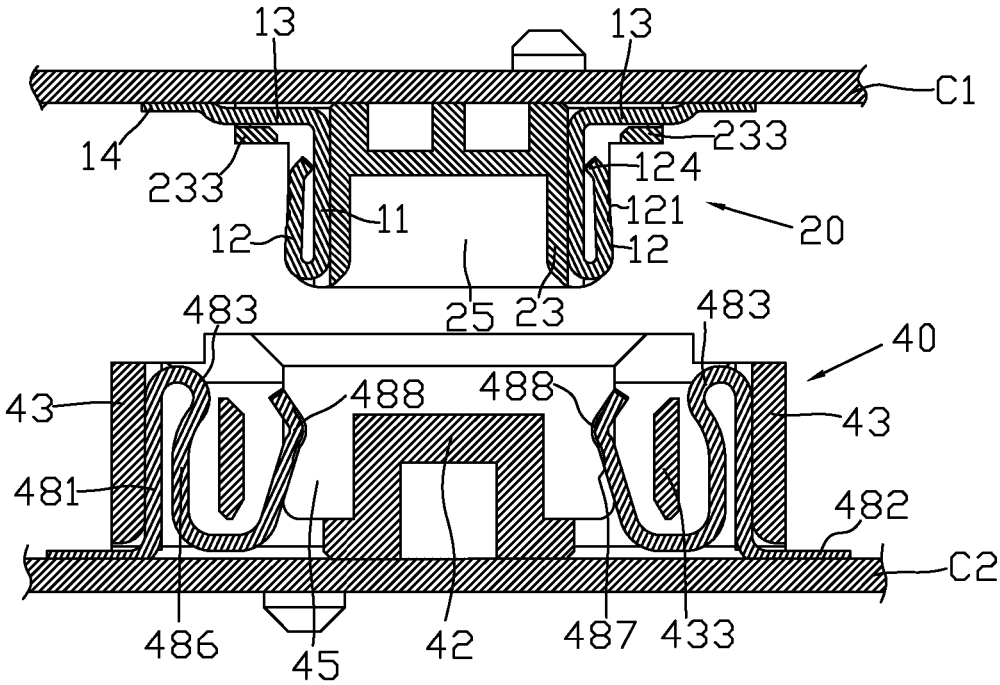
FIG. 9 is a cross-sectional view of the board-to-board connector, wherein the plug connector of FIG. 3 and the receptacle connector of FIG. 6 are mounted to a male and a female printed circuit boards respectively and separated from each other.

Referring to FIG. 3 and FIG. 9, a plurality of the electrical terminals 10 is mounted in a plug connector 20 of a board-to-board connector (not labeled). The board-to-board connector includes a receptacle connector 40 and the plug connector 20 which are mated with each other and respectively mounted to a female printed circuit board C2 and a male printed circuit board C1 to make the printed circuit boards C2, C1 electrically connected with each other. The plug connector 20 further includes a first insulating housing 21.

Figure 4:
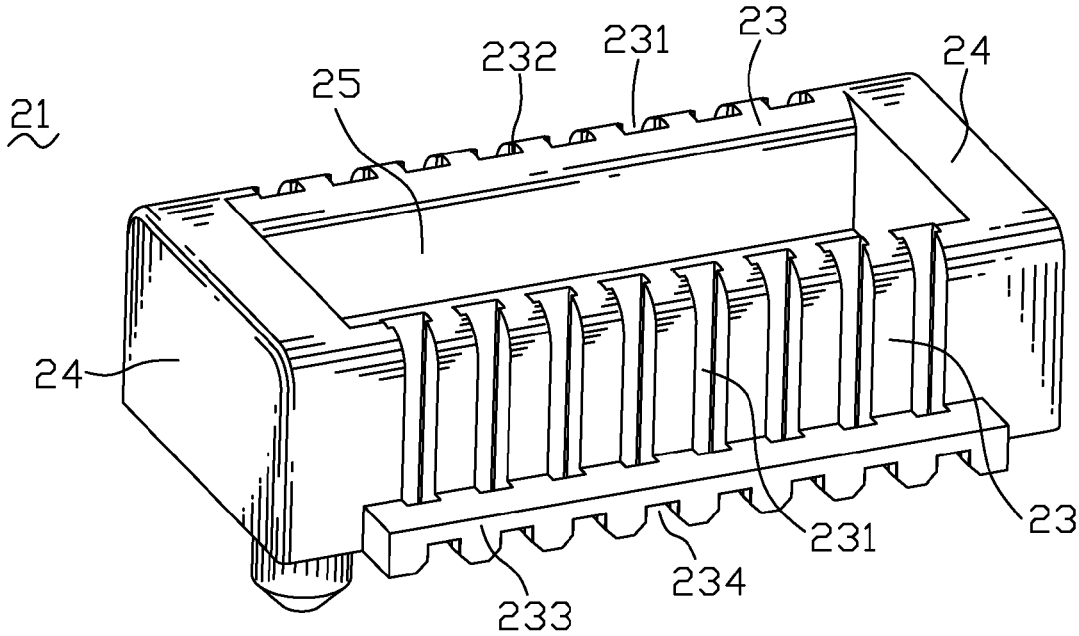
FIG. 4 is a perspective view of a first insulating housing of the plug connector of FIG. 3.
Figure 5:
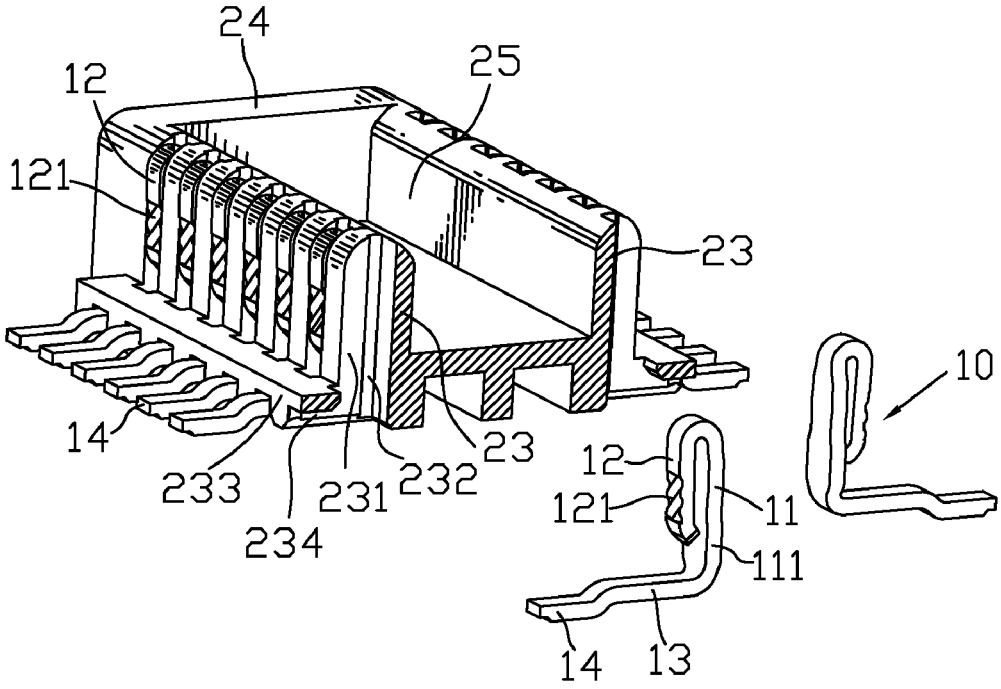
FIG. 5 is a sectional view of the plug connector of FIG. 3, with two electrical terminals being exposed therefrom.

Referring to FIG. 4 and FIG. 5, the first insulating housing 21 is rectangular and a middle of a bottom thereof is concaved upward to form a rectangular receiving space 25. Accordingly, four first sidewalls are formed around the receiving space 25 and have two facing each other and extending longwise to be designated as 23 and another two designated as 24. A top of an outside of each first sidewall 23 protrudes outward to form a preventing rib 233 extending longwise. Two opposite outsides of the first sidewalls 23 respectively define a plurality of terminal passageways 231 arranged at regular intervals along a longwise direction thereof and each extending vertically to penetrate therethrough. The inmost of each of the terminal passageways 231 oppositely extends sideward to form a pair of fastening fillisters 232 each extending vertically. A top end of each of the terminal passageways 231 further extends outward to penetrate through a top and an outside of the corresponding preventing rib 233 to form a receiving cavity 234.

Referring to FIGS. 3-5 again, when the plug connector 20 is assembled, the electrical terminal 10 is inserted downward into the corresponding terminal passageway 231 of the first insulating housing 21 until the connecting arm 13 is disposed into the corresponding receiving cavity 234 and prevented by the preventing rib 233. At this time, the fastening arm 11 and the contact arm 12 of the electrical terminal 10 are received in the corresponding terminal passageway 231 with the contact arm 12 facing outward, the fastening projections 111 are fastened in the respective fastening fillisters 232, and the soldering tail 14 is exposed out of the corresponding preventing rib 233 for being soldered with the male printed circuit board C1 shown in FIG. 9.

Figure 6:
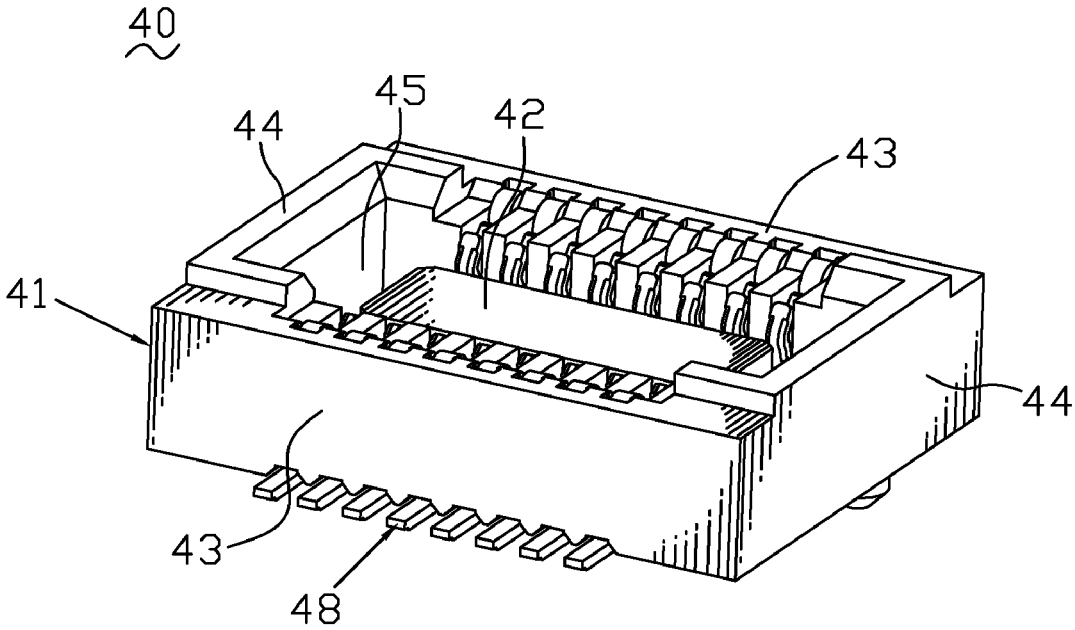
FIG. 6 is a perspective view of a receptacle connector of the board-to-board connector of the present invention.

Referring to FIG. 6, the receptacle connector 40 is mated with the plug connector 20 and includes a second insulating housing 41 and a plurality of receptacle terminals 48 disposed in the second insulating housing 41 respectively.

Figure 7:
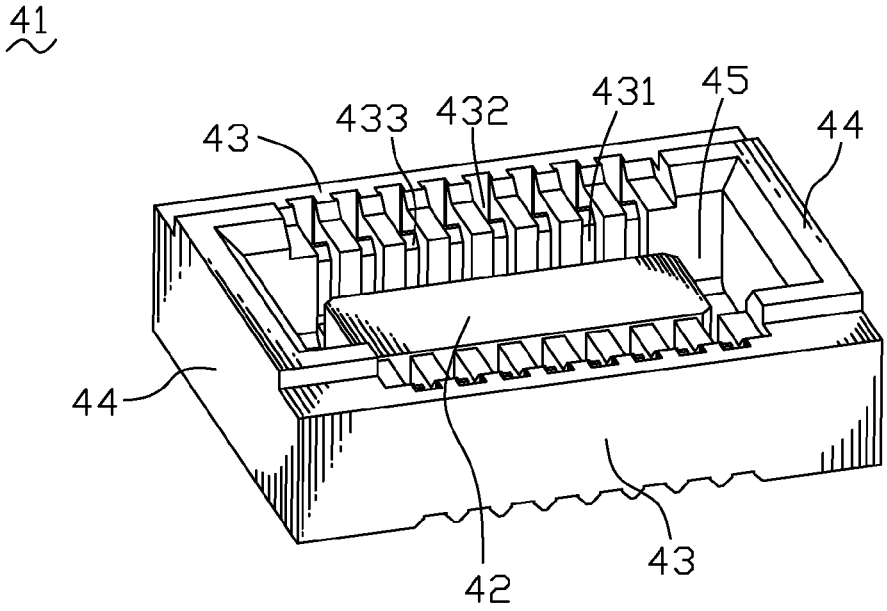
FIG. 7 is a perspective view of a second insulating housing of the receptacle connector of FIG. 6.
Figure 8:
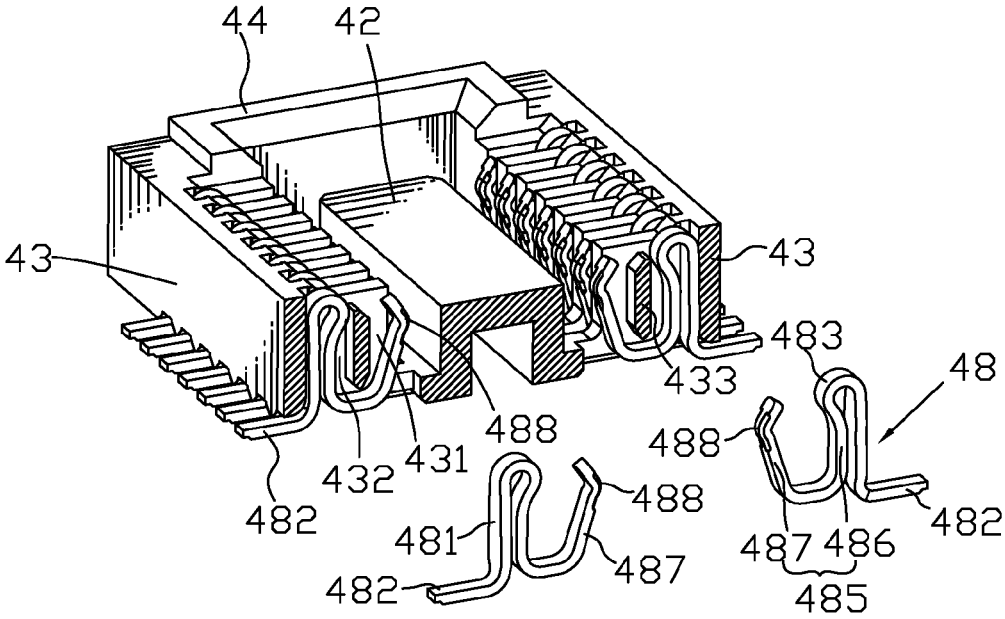
FIG. 8 is a sectional view of the receptacle connector of FIG. 6, with two receptacle terminals being exposed therefrom.

Referring to FIG. 7 and FIG. 8, the second insulating housing 41 is rectangular and a top thereof is concaved downward to form a rectangular ring-shaped receiving recess 45. Accordingly, four second sidewalls are formed around the receiving recess 45 and have two facing each other and extending longwise to be designated as 43 and another two designated as 44. An inserting wall 42 is formed among the receiving recess 45 and extends longwise to parallel the second sidewalls 43. An inside of each of the second sidewalls 43 vertically defines a plurality of receiving channels 431 communicating with the receiving recess 45. Each of the second sidewalls 43 further defines a plurality of receiving perforations 432 each extending vertically to penetrate therethrough and aligned with the corresponding receiving channels 431 to be further connected at a bottom thereof. Accordingly, a preventing portion 433 is formed between the receiving channel 431 and the corresponding receiving perforation 432.

Referring to FIG. 8 again, each of the receptacle terminals 48 is stamped from a metal bar and has a base arm 481. One end of the base arm 481 extends towards a perpendicular direction thereof to form a soldering arm 482, and the other end of the base arm 481 extends toward an opposite direction to the soldering arm 482 to form a U-shaped elastic body 485. The elastic body 485 has a first elastic arm 486 connected with the base arm 481 and parallelly facing the base arm 481, and a second elastic arm 487 of which a free end is bent opposite to the first elastic arm 486 to form a contact portion 488. The junction of the first elastic arm 486 and the base arm 481 is arched towards the second elastic arm 487 to form a fortified portion 483 for strengthening the connection of the first elastic arm 486 and the base arm 481.

Referring to FIGS. 6-8, when the receptacle connector 40 is assembled, the receptacle terminal 48 is inserted upward with the base arm 481 and the first elastic arm 486 received in the corresponding receiving perforation 432 of the second insulating housing 41, the second elastic arm 487 received in the corresponding receiving channel 431 and the contact portion 488 stretching into the receiving recess 45. A connecting portion of the elastic body 485 connecting the first elastic arm 486 and the second elastic arm 487 is located under the corresponding preventing portion 433. The soldering arm 482 is located under the corresponding second sidewall 43 and projects out of the second sidewall 43 for being soldered with the female printed circuit board C2 shown in FIG. 9.

Figure 10:
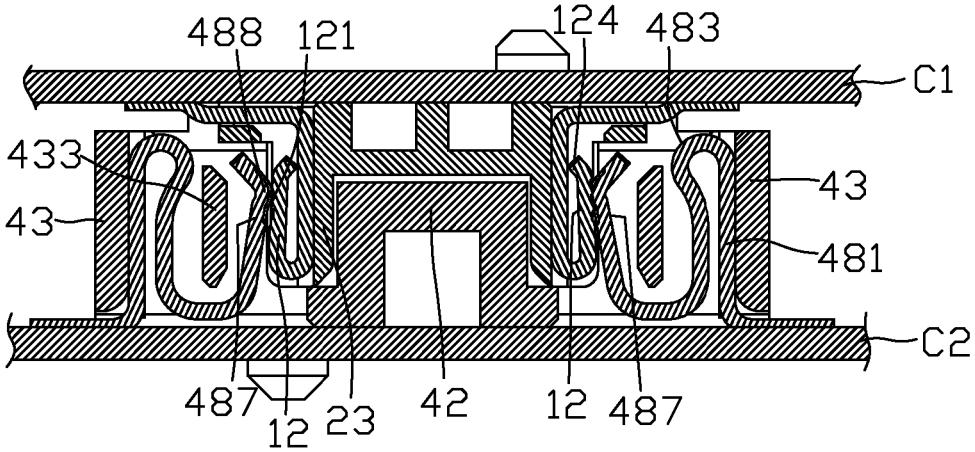
FIG. 10 is a cross-sectional view of the board-to-board connector, wherein the plug connector mounted to the male printed circuit board is engaged with the receptacle connector mounted to the female printed circuit board.

Referring to FIG. 9 and FIG. 10, when the plug connector 20 is engaged with the receptacle connector 40, the first sidewalls 23, 24 of the first insulating housing 21 are inserted in the receiving recess 45 of the second insulating housing 41 and the inserting wall 42 is inserted in the receiving space 25. The contact portion 488 of the receptacle terminal 48 electrically abuts against the contact area 121 of the corresponding electrical terminal 10 to form an electrical connection between the plug connector 20 and the receptacle connector 40 for further making the printed circuit boards C1, C2 electrically connected with each other.

As described above, the free end of the contact arm 12 of the electrical terminal 10 is designed by the prop portion 124 against the fastening arm 11 so that strengthens the connection of the contact arm 12 and the fastening arm 11 to prevent the contact arm 12 from breaking at the junction of the contact arm 12 and the fastening arm 11 during inserting/withdrawing the plug connector 20 into/out of the receptacle connector 40. Furthermore, the contact area 121 of the electrical terminal 10 includes the concave fillisters 123 and the contact ribs 122 arranged alternately to be scraggy so that ensures a firm contact between the electrical terminal 10 and the corresponding receptacle terminal 48. So a steady electrical connection can be achieved between the plug connector 20 and the receptacle connector 40 and further between the printed circuit boards C1, C2.

What is claimed is:

1. An electrical terminal adapted for being mounted in a connector, comprising:

an elastic portion of a substantially U-shape, the elastic portion including a fastening arm and a contact arm spaced from the fastening arm, the contact arm defining a contact area back to the fastening arm for electrically contacting an external mating terminal; and a soldering tail connected with a free end of the fastening arm;

wherein the contact area has a plurality of concave fillisters and contact ribs parallel one another to be alternately arranged and each extended at an incline to an inserting direction of the external mating terminal.

2. The electrical terminal as claimed in claim 1, wherein a portion of the contact arm is protruded towards the fastening arm to form a prop portion for preventing the elastic portion from deformation.

3. The electrical terminal as claimed in claim 2, wherein the prop portion is formed by a free end of the contact arm being bent towards the fastening arm.

4. The electrical terminal as claimed in claim 2, wherein the prop portion is against the fastening arm.

5. The electrical terminal as claimed in claim 1, wherein the inmost of each of the concave fillisters has a 0.005 mm~0.15 mm drop relatively to the contact rib.

6. The electrical terminal as claimed in claim 1, wherein a connecting arm is connected between the free end of the fastening arm and the soldering tail, the connecting arm is perpendicular to the fastening arm and formed at the same side as the contact arm.

7. A board-to-board connector, comprising a plug connector having:

a first insulating housing vertically defining a plurality of terminal passageways at two opposite sides thereof; and a plurality of electrical terminals disposed at the corresponding terminal passageways, each of the electrical terminals having an elastic portion of a substantially U-shape, the elastic portion including a fastening arm and a contact arm spaced from the fastening arm, a soldering tail connected with a free end of the fastening arm, the contact arm defining a scraggy contact area back to the fastening arm;

wherein the fastening arm is fastened in the corresponding terminal passageway with the contact area of the contact arm facing outward, the soldering tails project out of the two opposite sides of the first insulating housing, a top of the two opposite sides of the first insulating housing oppositely protrudes outward to respectively form a preventing rib spanning the corresponding terminal passageways, a connecting arm is connected between the free end of the fastening arm and the soldering tail to be restricted by the corresponding preventing rib.

8. The board-to-board connector as claimed in claim 7, wherein the contact area includes a plurality of concave fillisters and contact ribs parallel one another to be alternately arranged and each extended at an incline to an extending direction of the contact arm.

9. The board-to-board connector as claimed in claim 8 wherein the inmost of each of the concave fillisters has a 0.005 mm~0.15 mm drop relatively to the contact rib.

10. The board-to-board connector as claimed in claim 7, wherein a portion of the contact arm is protruded towards the fastening arm to form a prop portion for preventing the elastic portion from deformation.

11. The board-to-board connector as claimed in claim 10, wherein the prop portion is formed by a free end of the contact arm being bent towards the fastening arm.

12. The board-to-board connector as claimed in claim 11, wherein the prop portion is against the fastening arm.

13. The board-to-board connector as claimed in claim 7, wherein the connecting arm is perpendicular to the fastening arm and formed at the same side as the contact arm.

14. The board-to-board connector as claimed in claim 7, wherein the inmost of each of the terminal passageways oppositely extends sideward to form a pair of fastening fillisters, two opposite side edges of the fastening arm of each of the electrical terminals protrude oppositely to form two fastening projections fastened in the corresponding fastening fillisters.

15. A board-to-board connector, comprising a plug connector and a receptacle connector mating with the plug connector, the plug connector having:

a first insulating housing vertically defining a plurality of terminal passageways at two opposite sides thereof; and a plurality of electrical terminals disposed at the corresponding terminal passageways, each of the electrical terminals having an elastic portion of a substantially U-shape, the elastic portion including a fastening arm and a contact arm spaced from the fastening arm, a soldering tail connected with a free end of the fastening arm, the contact arm defining a scraggy contact area back to the fastening arm;

wherein the fastening arm is fastened in the corresponding terminal passageway with the contact area of the contact arm facing outward, and the soldering tails project out of the two opposite sides of the first insulating housing; and the receptacle connector having:

a second insulating housing of which a top defines a receiving recess for receiving the first insulating housing of the plug connector therein, four sidewalls being formed around the receiving recess, two facing insides of two of the sidewalls vertically defining a plurality of receiving channels communicating with the receiving recess, the two sidewalls further vertically defining a plurality of receiving perforations corresponding to the receiving channels; and a plurality of receptacle terminals each having a base arm, a soldering arm connected with a lower end of the base arm and a U-shaped elastic body connected with an upper end of the base arm, the elastic body having a first elastic arm connected with the base arm and parallelly facing the base arm, and a second elastic arm of which a free end is bent opposite to the first elastic arm to form a contact portion;

wherein the base arm and the first elastic arm are received in the corresponding receiving perforation, the second elastic arm is received in the corresponding receiving channel, the contact portion stretches into the receiving recess to electrically abut against the contact area of the corresponding electrical terminal, and the soldering arm is located under the corresponding sidewall and projects out of the sidewall.

16. The board-to-board connector as claimed in claim 15, wherein the junction of the first elastic arm and the base arm is arched towards the second elastic arm to form a fortified portion.

17. The board-to-board connector as claimed in claim 15, wherein the elastic body and the soldering arm are formed at two opposite sides of the base arm.

18. The board-to-board connector as claimed in claim 15, wherein a preventing portion is formed between the receiving channel and the corresponding receiving perforation, a connecting portion of the elastic body connecting the first elastic arm and the second elastic arm is located under the corresponding preventing portion.

19. The board-to-board connector as claimed in claim 15, wherein the receiving recess is ring-shaped and an inserting wall is formed among the receiving recess, a bottom of the first insulating housing defines a receiving space for receiving the inserting wall therein.

* * * * *